US011109653B2

(12) United States Patent
AlQunaibit

(10) Patent No.: US 11,109,653 B2
(45) Date of Patent: Sep. 7, 2021

(54) JEWELRY ORNAMENT WITH CLASP MECHANISM

(71) Applicant: Haneen AlQunaibit, Riyadh (SA)

(72) Inventor: Haneen AlQunaibit, Riyadh (SA)

( * ) Notice: Subject to any disclaimer, the term of this patent is extended or adjusted under 35 U.S.C. 154(b) by 22 days.

(21) Appl. No.: 16/785,484

(22) Filed: Feb. 7, 2020

(65) Prior Publication Data

US 2021/0244141 A1 Aug. 12, 2021

(51) Int. Cl.
*A44C 25/00* (2006.01)

(52) U.S. Cl.
CPC ..... *A44C 25/007* (2013.01)

(58) Field of Classification Search
CPC ... A44C 25/001; A44C 25/002; A44C 25/005; A44C 15/005; A44C 15/0055; A41D 25/022
USPC ..... 63/3.2; 24/57, 66.9, 66.11
See application file for complete search history.

(56) References Cited

U.S. PATENT DOCUMENTS 2,637,884 A * 5/1953 Morehouse ..... A44C 5/22 24/336
3,074,135 A * 1/1963 Brodowski ..... A43C 7/00 24/712.5
3,347,037 A * 10/1967 Klang ..... A44C 11/005 63/21
3,974,545 A * 8/1976 Lossini ..... A44C 11/005 24/116 R
5,365,641 A * 11/1994 Watanabe ..... A45C 13/1046 24/115 G
2007/0251269 A1* 11/2007 Grosser-Samuels ..... A44C 15/005 63/3.1
2017/0150772 A1* 6/2017 Nussbaum ..... A43C 7/00

* cited by examiner

*Primary Examiner* — Jack W Lavinder
(74) *Attorney, Agent, or Firm* — Ostrolenk Faber LLP

(57) ABSTRACT

A jewelry ornament for being adjustably affixed to a jewelry chain has an ornament body that can be affixed to the jewelry chain, with a jewelry decoration, preferably a precious stone setting, formed at the front side of the jewelry body. A number of openings formed at the rear side of the ornament body allow a free end of the jewelry chain to be threaded through the ornament body, in a manner that guides one strand of the jewelry chain to extend along the left side of the ornament and a second, spaced strand of the jewelry strand to extend along the right side of the ornament. A holding mechanism includes a pressing plate configured to press on the first and second strands of the jewelry chain to immovably affix the jewelry ornament to the jewelry chain at a desired location along said first and second strands of said jewelry chain.

11 Claims, 4 Drawing Sheets

JEWELRY ORNAMENT WITH CLASP MECHANISM

BACKGROUND OF THE INVENTION

The present invention generally relates to jewelry and, more particularly, to a jewelry ornament that can be adjustably mounted to jewelry bracelets, necklaces or chains, in a manner that allows its location on the necklace to be easily and conveniently adjusted to suit individual needs and tastes.

Jewelry necklaces, chains and bracelets in general have long enjoyed wide popularity. In typical use, a jewelry necklace is donned over a wearer's neck and a jewelry ornament is positioned on the necklace, dangling at the bottom of the necklace on the wearer's chest. The location of the ornament on the wearer's chest needs to be precisely placed to suit the wearer's figure, personal preferences and taste. The jewelry ornament can be any type of jewelry ornament under the sun and typically may be a precious metal ornament or a jewelry setting with precious stones such as diamonds and the like mounted therein. The ornament can also be attached to a wrist bracelet and dangled therefrom.

A drawback of the prior art is that the jewelry ornament requires selection by the wearer of a particular-sized necklace or hand bracelet, so that the ornament becomes positioned on the wearer's chest at the desired location.

With reference to prior art FIG. 5 herein, the jewelry ornament 6 may comprise a setting that accommodates four gemstones 8. A connecting circular ring 9 at one end of the ornament 6 enables the necklace 2 to be threaded therethrough, all in well-known manner. Necklaces come in various standardized sizes measured in inches or centimeters of length and the wearer has to select the right-sized necklace that suits the particular person and ornament style or clothing and the like.

A general objective of the present invention is to avoid the aforementioned and other prior art drawbacks, by providing a jewelry ornament that can be affixed to jewelry chains, necklaces and bracelets, in a manner such that the position of the jewelry ornament can be moved along the necklace to a precise location thereon without the risk of it moving or changing its position during use.

In a preferred embodiment, it is an object of the invention to provide an easy mechanism for allowing wearers to don the necklace, bracelet, or anklet by themselves, without someone's help.

In another embodiment, the invention allows for the necklace etc. to be continuous, one sized with the jewelry adornment including the clasp. The clasp can be a "button" style jewelry ornament itself with set gems, in any shape or just comprising only a metal.

SUMMARY OF THE INVENTION

Accordingly, it is an object of the present invention to provide a jewelry ornament that includes a mechanism that affixes the location of the jewelry ornament to a jewelry chain, necklace and the like, adjustably and securely.

It is another object of the invention to provide a jewelry ornament with a clasp mechanism that is simple to implement and easy to use.

Another abject of the invention is to provide a jewelry ornament whose position on a necklace can be adjusted while it is being worn.

The foregoing and other objects of the invention are realized in accordance with the present invention with a jewelry ornament that can be realized, in accordance with an embodiment thereof, by a jewelry setting that optionally supports one or more precious stones and which has a body that allows the jewelry chain, necklace or the like to be threaded thereto.

In an embodiment of the invention, the jewelry ornament comprises: an ornament body including a front side and a rear side, an upper end and a lower end that hangs lower relative to the upper end when jewelry ornament is affixed to the jewelry chain, a left side and a right side; a jewelry decoration formed at the front side of the jewelry body, located to be seen when the ornament body is affixed to the jewelry chain; a plurality of openings formed at the rear side of the ornament body and so located as to allow a free end of the jewelry chain to be threaded through the ornament body, in a manner that guides one strand of the jewelry chain to extend along the left side of the ornament and a second, spaced strand of the jewelry strand to extend along the right side of the ornament; and a holding mechanism including a pressing surface that is configured to press on the first and second strands of the jewelry chain to immovably affix the jewelry ornament to the jewelry chain at a desired location along said first and second strands of said jewelry chain. The jewelry decoration comprises a jewelry setting that supports at least one precious stone, including arranged in a matrix.

The jewelry ornament has a setting with an outer geometric peripheral shape selected from the group consisting of square, rectangular, oval round and other regular or irregular shapes.

In a preferred embodiment, the ornament body comprises a precious stone setting, a casing configured to receive in an interior space thereof the precious stone setting which is insertable and securable within the casing and said plurality of openings passing through wall surfaces of both said precious stone setting and said casing to enable the threading therethrough said first and second strands of said jewelry chain. Also included is a spring biased pressing plate located in the casing and movable within the interior of the casing to selectively clear a threading path through said openings for said strands when pressure is applied to said pressing plate, and to enable said pressing plate to press on said first and second strands of said jewelry chain to maintain a position of stability between said ornament body and said first and second strands of said jewelry chain when said pressure is removed from said pressing plate. Also, one of said ornament casing and said precious stone setting comprises a plurality of protrusions and the other one of said casing and said precious stone setting comprises a plurality of grooves and wherein the protrusions and the grooves are configured to enable the protrusion to snap into the grooves to secure the precious stone setting in the interior space of the casing.

In an embodiment, the jewelry ornament and jewelry chain combination has two dangling jewelry strands located below the jewelry ornament. The plurality of openings include lower openings located adjacent the lower end of said ornament body and wherein said openings located adjacent the lower end of the ornament body are positioned closer to each other than corresponding ones of said plurality of openings that are located adjacent said upper end of said ornament body.

In an embodiment, a second jewelry ornament is mounted to the jewelry chain, below the main ornament. A clasp is included that is configured to be attached at a location on said jewelry chain that is located behind the neck of a wearer, to enable adjusting a length dimension of said jewelry chain.

Other features and advantages of the present invention will become apparent from the following description of the invention which refers to the accompanying drawings.

DETAILED DESCRIPTION OF PREFERRED EMBODIMENTS OF THE INVENTION

Figure 1:
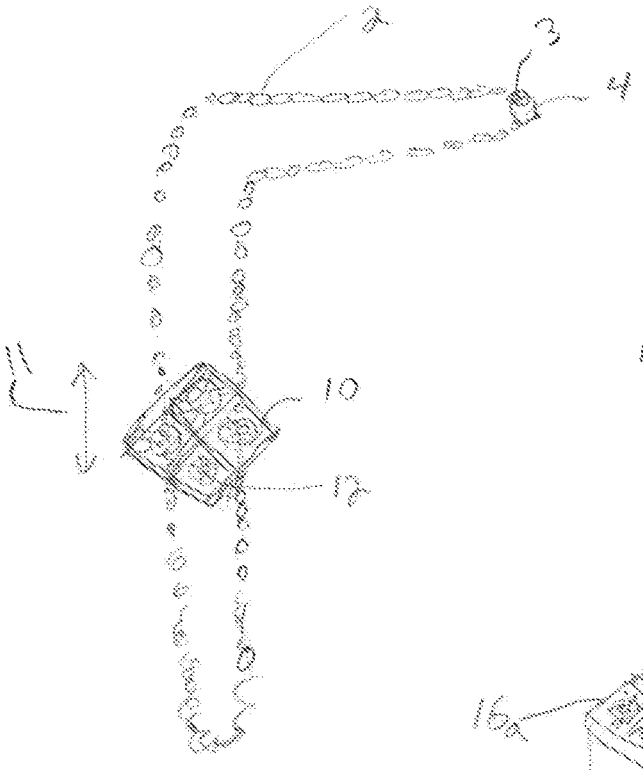
FIG. 1 shows a perspective view of the present invention including an adjustably locatable jewelry ornament affixed to a necklace.

With reference to the drawings, FIG. 1 shows a conventional jewelry chain or necklace 2 that has two ends. One end of the necklace terminates in a ring 3 that can be inserted into a finger operated clasp 4. The wearer dons the necklace around her neck and locks the ring 3 in the clasp 4, behind her neck, all in well-known and widely used manner. In another embodiment, the elements 3 and 4 constitute just a jewelry ornament. In accordance with one aspect of the present invention, a jewelry ornament 10 may supports a plurality of precious stones 12 and is mounted to the necklace 2, in a manner that allows the ornament 10 to be adjustably affixed on the chain 2, up or down on the necklace, as indicated by the arrow 11.

Figure 1A:
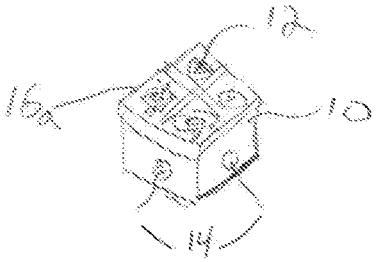
FIG. 1*a* shows the jewelry ornament in a perspective view, including the necklace threading openings.

More specifically, the jewelry ornament 10 is formed with four through-going openings, including front facing openings 14 and juxtaposed rear openings as shown in FIG. 1*a*. The two juxtaposed rear openings (not shown) are at the rear end. As more fully explicated below, the necklace 20 can be threaded through the openings, as later explained.

Figure 1B:
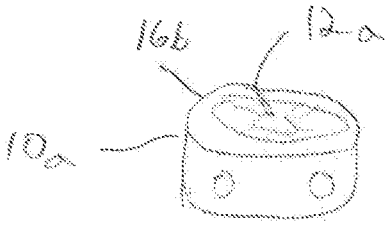
FIGS. 1*b*, 1*c* and 1*d* show the jewelry ornament in different configurations and shapes.
Figure 1C:
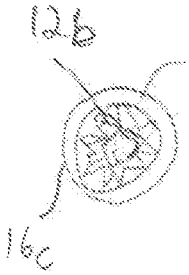
Figure 1D:
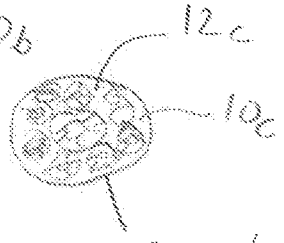
Figure 5:
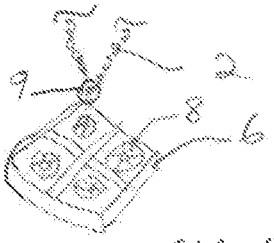
FIG. 5 (PRIOR ART)
FIG. 5 is a perspective of a prior art jewelry ornament dangling from a necklace.

While the ornament 10 is shown to have a square shaped perimeter 16*a*, it will be recognized by persons of skill in the art that the shape of the ornament is not limited to the shape shown, as the perimeter shape may assume other shapes, for example, an oval perimeter 16*b* as shown in FIG. 1*b*, a circular perimeter as shown in FIGS. 1*c* and 1*d* or any shape whatsoever, including irregular shapes as well. Moreover, the precious stones can be in the form of a solitaire oval stone 12*a* as shown in FIG. 1*b*, a round stone as shown in FIG. 1*c* or a cluster stone arrangement 12*c* as shown in FIG. 1*d*, which comprises a center stone surrounded by smaller size stones, all as well-known in the art. In yet other embodiments, the ornament 10 is a decoratively formed of metal only, e.g. gold, silver and the like. The ornament can be large or small and anything in between.

Figure 2:
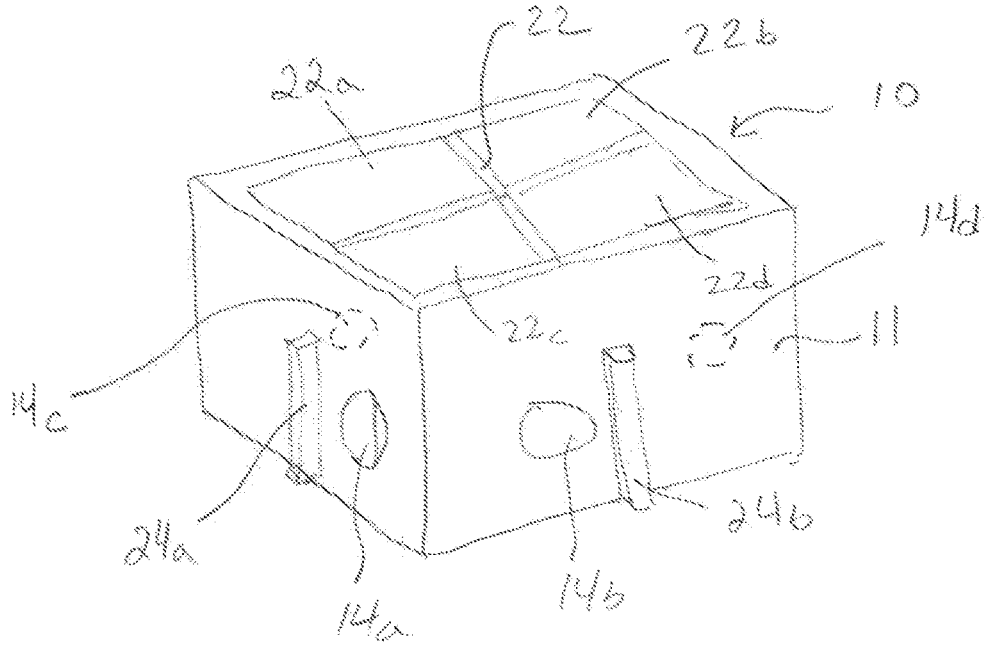
FIG. 2 is a perspective of the first component of the jewelry ornament, which includes a jewelry setting for precious stones.
Figure 3:
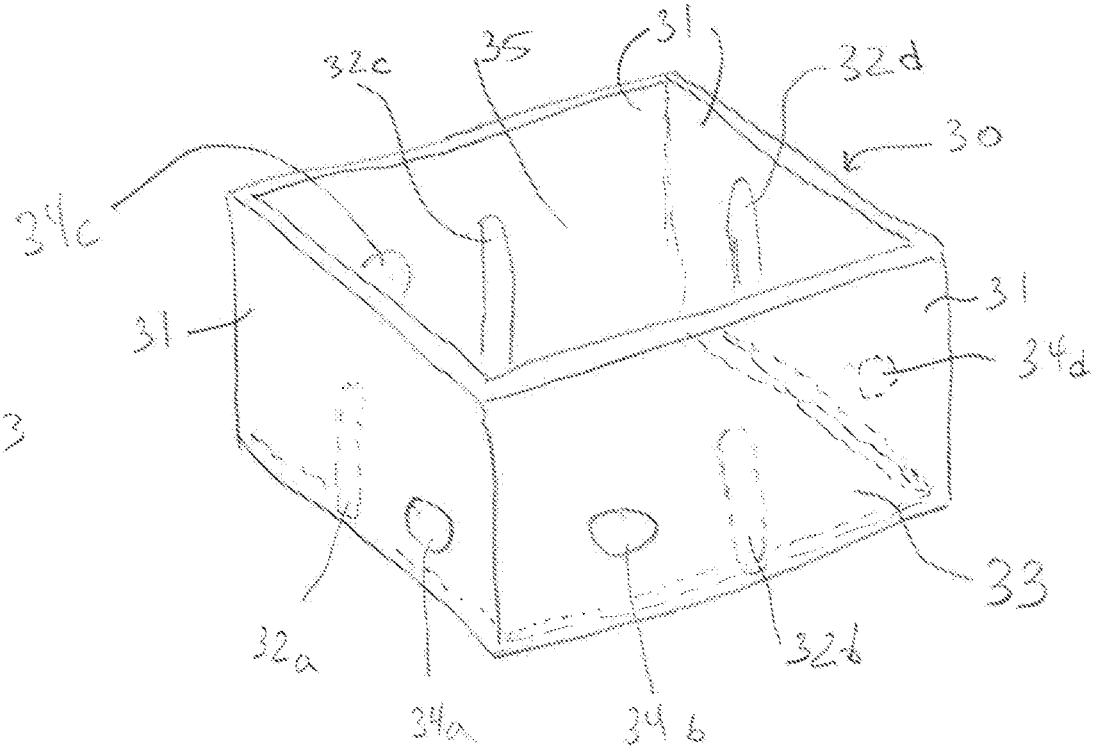
FIG. 3 is a perspective which shows a second component of the jewelry ornament, which constitutes a casing that receives the jewelry setting.
Figure 4:
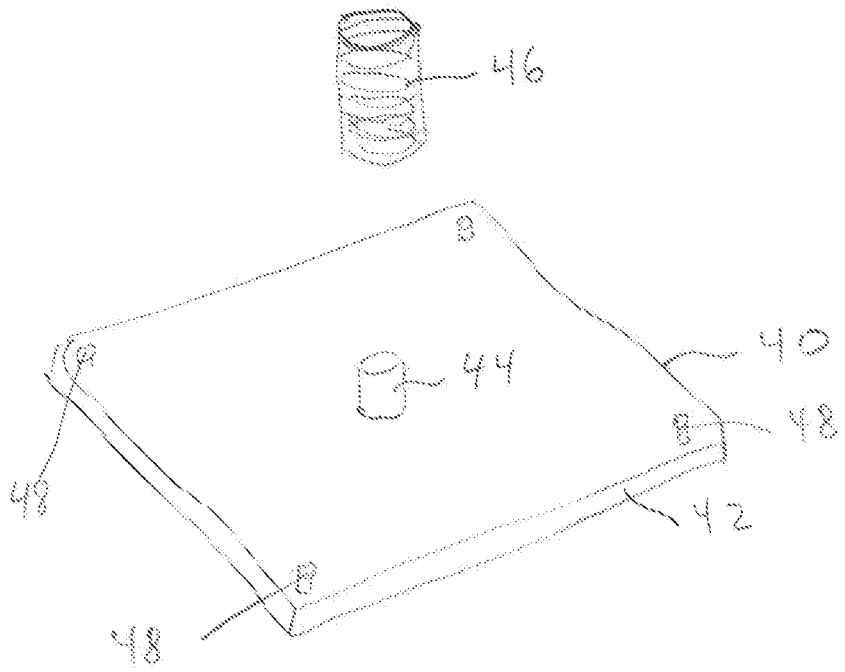
FIG. 4 shows a third component of the jewelry ornament which provides a biasing force that selectively presses the ornament to the necklace, or loosens the grip on the necklace to allow moving the ornament along the necklace.

The jewelry ornament 10 comprises in accordance with one embodiment three main inter-assembled components that are respectively shown in FIGS. 2, 3 and 4, assembled as explained below. Thus, the jewelry ornament 10 comprises a casing 30 (FIG. 3) that has four side walls 31, a bottom wall 33 that is open at its center and an open top. The casing 30 is sized to enable inserting therein a pushing plate 40 (FIG. 4) that is dropped into the casing 30 and placed on the bottom wall ledge 33, with the spring 36 affixed to the holding prong 44. The plate 40 also includes aligning/orientation pins 48 pointing upward. The casing 30 comprises four openings, front openings 32*a* and 34*b* and rear openings 34*c* and 34*d*, for the passage of the necklace 2 therethrough.

The jewelry setting 11, which similarly has four outer walls dimensioned to just fit inside the interior 35 of the casing 30, is mounted into the casing 30, in a manner that allows it to lock therein, as later explained. Also, the setting 11 has front openings 14*a* and 14*b* and rear openings 14*c* and 14*d*. When the setting 11 is placed inside the casing, the openings 34*a*, 34*b*, 34*c* and 34*d* of the casing 30 become respectively registered with the openings 14*a*, 14*b*, 14*c* and 14*d* of the setting 11.

The jewelry setting 11 comprises at the top thereof a jewelry setting 22 that defines the mounting locations 22*a*, 22*b*, 22*c* and 22*d* for four round or square shaped precious stones, e.g., diamonds, rubies or the like, which are mounted therein in any of the conventional known precious stone mounting methods.

Each of the four walls of the setting 11 comprises an elongate, generally rectangular protrusion, namely front protrusions 24*a*, 24*b* as well as two similar protrusions (not shown) on the other two, rear side walls. The protrusions are strategically located and sized so that when the setting 11 is forcibly pushed into the casing 30, the casing side walls spread apart and the protrusions on the setting 11 snap into four corresponding grooves 32*a*, 32*b*, 32*c* and 32*d* formed on the interior sides of the side walls of the casing 30.

While the casing 30 and the setting 11 are now immovably secured to each other, that is not so with the pushing plate 40. That is, owing to the biasing action of the spring 46 (FIG. 4), the plate 40 is normally pushed against the bottom ledge of the casing 30. However, pushing the plate with a finger located at the bottom of the ornament, forces the plate 40 away from the bottom of the casing 30, leaving a space for threading the necklace through the aforementioned openings in the ornament 10 as explained below.

That is, when the plate 40 is pushed up, a space is created at the bottom that allows the jewelry chain 2 to be threaded through the registered openings of the setting/casing ensemble. That is, the free, ring end 3 of the necklace 2 is threaded through both sets of openings 34*a*/34*c* and 34*b*/34*c* of the casing 30. This causes the ornament 10 to be attached to the necklace 2 as shown in FIG. 1. Once the necklace has been threaded through, one lets go of applying the finger pressure on the bottom of the plate 40, and the plate 40 then pushes on the necklace owing to the spring 46, clasping the necklace firmly and affixing the position of the jewelry ornament 10 on both sides of the necklace loop, right and left, as shown in FIG. 1. Thus, by the simple and easily implemented mechanism described above, the jewelry ornament 10 can be held in one's hand between two fingers, which when pressed, allows the position of the ornament 10 to be moved up and down along the direction indicated by the arrow 11 in FIG. 1.

In another embodiment that has been reduced to practice, the setting 11, casing 30 and the plate 40 are inter-assembled by soldering the plate 40 to the bottom of the casing 30, with the spring 46 pressing on the setting 11 upwards. When the setting 11 is pressed up in the casing 30, the openings 14 in the setting are mis-aligned with the openings 34 in the casing 30, thereby causing the strands of the chain 2 to become positionally fixed to the ornament 10. To initially thread the chain into the ornament, or to alter the position of the ornament relative to the chain, on presses the entire ornament between two fingers, e.g., the thumb and the index finger. This aligns the openings of the casing and the setting and enables to move the ornament along the strands of the chain.

Thereby, the drawback of the prior art is easily and elegantly solved. Thus, a wearer, typically a lady that has an expensive jewelry ornament, for example, an ornament that is laden with expensive diamonds, can use any necklace shape or type and easily thread it through a desired necklace or bracelet and then adjust the position of the ornament on her front to suit a desired style or jewelry appearance. The wearer can mount the ornament closer to the neck or lower on the chest, depending on the type of clothing being worn, the type of ornament that it is and the type of look that the wearer seeks to convey with her jewelry and her clothing.

While the invention has been described above in relation a necklace, this same concept can be used with an ornament that would fit on a bracelet that is worn on one's wrist or even utilized with earrings, where the ornament sits on a chain that is hanging from one's ear and the location of the ornament is capable of being moved up and down as desired or even exchanged with different ornaments and the like. Similarly, while the invention has been described where the ornament is stabilized by having two sets of through-going openings, the ornament can be designed so that it is provided with only one centered, through-going opening so that it can fit, for example, more easily and also be miniaturized so that it can be used with earrings or smaller sized jewelry. Still further, the setting may be integrated with the casing into a single body. Further, the openings for threading the necklace strands may be provided only in the walls of the casing, obviously having to provide threading openings in the jewelry setting.

Figure 6A:
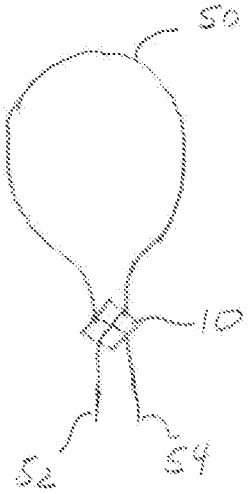
FIGS. 6*a*, 6*b*, 6*c* and 6*d* show various modifications of the necklace and ornament embodiments described above.
Figure 6B:
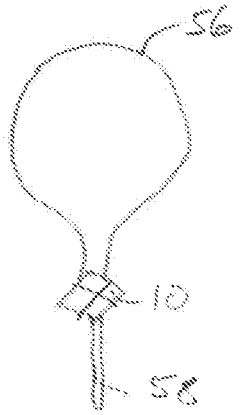

With reference to FIGS. 6*a*, 6*b*, 6*c* and 6*d*, FIG. 6*a* shows a necklace 50 that is not intended to form a closed loop as it has two dangling free ends 52 and 54, achieving a different look. In the embodiment of FIG. 6*b*, the necklace 56 passes through the ornament 10, which is modified so that the two strands of the dangling bottom section of the necklace are located to contact or almost contact each other, to achieve a different overall look.

Figure 6C:
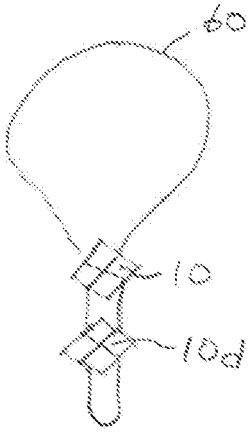
Figure 6D:
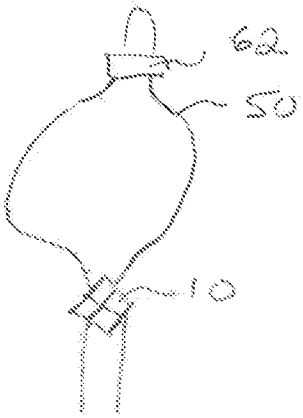

In the embodiment of FIG. 6*c*, the necklace 60 supports a second movable ornament 10*d*, which in general is similar to the jewelry ornament 10 described above. While not in and of itself novel, various beads or similar jewelry adornments can be located anywhere along the necklace wire. In FIG. 6*d*, the necklace 50 is provided with a clasp 62 which is not a jewelry ornament, but nonetheless functions as the ornament 10 described above in that it pinches off a portion of the necklace 50 located behind the neck, thereby shortening or adjusting its length for the purposes described above.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A jewelry ornament for being adjustably affixed to a jewelry chain, the jewelry ornament comprising:

an ornament body including a front side and a rear side, an upper end and a lower end that hangs lower relative to the upper end when jewelry ornament is affixed to the jewelry chain, a left side and a right side;

a jewelry decoration formed at the front side of the ornament body, located to be seen when the ornament body is affixed to the jewelry chain;

a plurality of openings formed adjacent the rear side of the ornament body and so located as to allow a free end of the jewelry chain to be threaded through the ornament body, in a manner that guides one strand of the jewelry chain to extend along the left side of the ornament body and a second, spaced strand of the jewelry chain to extend along the right side of the ornament body;

a holding mechanism including a pressing surface that is configured to press on the first and second strands of the jewelry chain to immovably affix the jewelry ornament to the jewelry chain at a desired location along said first and second strands of said jewelry chain; and wherein the ornament body comprises a precious stone setting, a casing configured to receive in an interior space thereof the precious stone setting which is insertable and securable within the casing and said plurality of openings passing through wall surfaces of both said precious stone setting and said casing to enable the threading therethrough said first and second strands of said jewelry chain.

2. The jewelry ornament of claim 1, wherein the precious stone setting is configured to support a plurality of precious stones arranged in a matrix.

3. The jewelry ornament of claim 1, wherein the precious stone setting has an outer geometric peripheral shape selected from the group consisting of square, rectangular, oval and round shapes.

4. The jewelry ornament of claim 1, further including a spring biased pressing plate located in the casing and movable within the interior of the casing to selectively clear a threading path through said plurality of openings for said strands when pressure is applied to said pressing plate, and to enable said pressing plate to press on said first and second strands of said jewelry chain to maintain a position of stability between said ornament body and said first and second strands of said jewelry chain when said pressure is removed from said pressing plate.

5. The jewelry ornament of claim 1, wherein one of said casing and said precious stone setting comprises a plurality of protrusions and the other one of said casing and said precious stone setting comprises a plurality of grooves and wherein the protrusions and the grooves are configured to enable the protrusion to snap into the grooves to secure the precious stone setting in the interior space of the casing.

6. The jewelry ornament of claim 1, in combination with said jewelry chain.

7. The jewelry ornament and jewelry chain combination of claim 6, wherein said jewelry chain is a necklace.

8. The jewelry ornament and jewelry chain combination of claim 7, wherein said necklace is provided with two dangling jewelry strands located below the jewelry ornament.

9. The jewelry ornament and jewelry chain combination of claim 7, wherein said plurality of openings include lower openings located adjacent the lower end of said ornament body and wherein said openings located adjacent the lower end of the ornament body are positioned closer to each other than corresponding ones of said plurality of openings that are located adjacent said upper end of said ornament body.

10. The jewelry ornament and jewelry chain combination of claim 7, further comprising a second jewelry ornament mounted to said jewelry chain, below said ornament body.

11. The jewelry ornament and jewelry chain combination of claim 7, further comprising a clasp configured to be attached at a location on said jewelry chain that is located behind the neck of a wearer, to enable adjusting a length dimension of said jewelry chain.

* * * * *